US007172224B2

(12) United States Patent
Carter

(10) Patent No.: US 7,172,224 B2
(45) Date of Patent: Feb. 6, 2007

(54) QUICK-RELEASE LATCH EXTENDER

(76) Inventor: Alan Carter, 13171 Phal Rd., Grass Lake, MI (US) 49240

( * ) Notice: Subject to any disclaimer, the term of this patent is extended or adjusted under 35 U.S.C. 154(b) by 126 days.

(21) Appl. No.: 10/668,758

(22) Filed: Sep. 23, 2003

(65) Prior Publication Data

US 2005/0062297 A1 Mar. 24, 2005

(51) Int. Cl.
*E05C 17/04* (2006.01)

(52) U.S. Cl. ..... 292/262; 292/288

(58) Field of Classification Search ..... 292/262, 292/263, 288, DIG. 37
See application file for complete search history.

(56) References Cited

U.S. PATENT DOCUMENTS 4,278,280 A * 7/1981 Rashbaum ..... 292/263
4,593,946 A * 6/1986 Rich ..... 292/288
4,667,993 A * 5/1987 Hannesson et al. ..... 292/339
5,165,742 A * 11/1992 Frayne ..... 292/262
5,551,738 A 9/1996 Thorlton ..... 292/262
6,048,045 A 4/2000 Nohata et al. ..... 347/7

* cited by examiner

*Primary Examiner*—Gary Estremsky
(74) *Attorney, Agent, or Firm*—Gifford, Krass, Groh, Sprinkle, Anderson & Citkowski, PC

(57) ABSTRACT

A latch extender with a quick-release mechanism for a vehicle of the type with a window having a U-shaped hasp that engages with a hasp-locking mechanism on the vehicle when the window is closed. The inventive device is configured to mount between the hasp and the locking mechanism to keep the window in a partially opened condition for ventilation purposes. The device preferably includes a body having first and second ends, the first end of the body including a substitute hasp for engaging with the hasp-locking mechanism on the vehicle, and the second end of the body including an opening for receiving the U-shaped hasp of the window. In contrast to existing devices, the body further includes a quick-release mechanism for engaging the U-shaped hasp of the window, the quick-release mechanism including a manually operated control on the body for releasing the U-shaped hasp of the window. In the preferred embodiment the manually operated control is a spring-biased pushbutton. The substitute hasp is also preferably generally U-shaped, and may be curved or bent to accommodate particular vehicle configurations.

3 Claims, 3 Drawing Sheets

(PRIOR ART -- USP #3,795,030)

QUICK-RELEASE LATCH EXTENDER

FIELD OF THE INVENTION

This invention relates generally to latching mechanisms for vehicles, including sport utility vehicles (SUVs) having rear windows that open and close with a latch and, in particular, to a device that extends to latch to keep the rear window in a partially opened condition for ventilation purposes.

BACKGROUND OF THE INVENTION

Sport utility vehicles (SUVs) such as the Ford Explorer have sold in large numbers over the past several years. These types of vehicles include a generally horizontal back door with a window that opens and closes with a latch.

FIG. 1, taken from FIG. 4 of U.S. Pat. No. 5,165,742, depicts the rear entranceway to the storage compartment of a vehicle 40. The entranceway is comprised of a two-piece door having upper and lower portions. The upper portion 42 of the door is comprised of a rear window enclosed in a frame and hingedly secured to the vehicle along its uppermost edge 44. The lower portion of the door is comprised of a solid section 46 which is hingedly secured to the vehicle along its lower edge 48. Upper portion 42 of the rear door may normally have two piston-type supports 49 secured to the window frame edges and secured internally to the vehicle such that upper portion 42 can be opened and maintained in a substantially-horizontal position 52 for access to the rear portion of the vehicle.

Lower door portion 46 is operable from the closed position to a substantially-horizontal open position to aid in access to the rear portion of the vehicle. When enclosing or securing the rear of the vehicle, lower portion 46 is first raised to a substantially vertical position where it lockingly engages the frame of the vehicle. The upper window portion 42 is then manually lowered such that hasp 54 positioned on the lower portion of the frame of upper portion 42 engages locking mechanism 56 within lower portion 46, thus securing the rear of the vehicle.

A problem oftentimes arises with respect to the operation of the aforesaid vehicles in that it is not possible to obtain any cross ventilation while operating the vehicle since the rear window is in a locked position. It is not advisable to operate the vehicle with the rear window in a totally upright position in that airflow around the vehicle and bumps encountered by the vehicle may damage the window supports. Additionally, operating the vehicle with the window in its upright open position could lead to the loss of luggage, equipment or the like stored in the storage area. Operating the vehicle with the passenger side window or driver's side window slightly open will provide some ventilation, but is not sufficient to remove cigarette smoke or the like, and oftentimes disrupts or interferes with the desired temperature that the operator wishes to maintain within the vehicle.

The '742 patent referenced above is directed to a mechanism which easily mounted on the existing latch of the rear window of such a vehicle which allows the rear window to be lowered and engaged, with the locking mechanism of the lower portion of the door to secure the window in a locked mode yet still provide for a passageway between the upper window portion of the rear door and the lower solid portion of the rear door such that airflow and ventilation within the vehicle will flow rearwardly and exit through this passageway, the passageway being of such a dimension that luggage, equipment or the like stored behind the rear seat cannot exit the vehicle.

FIG. 2, taken from FIG. 5 of the '742 patent illustrates the window latch extender assembly 10 being secured to hasp 54 of upper window portion 42. FIG. 3, taken from FIG. 6 of the '742 patent, illustrates the manner in which the window latch extender assembly 10 then engages the locking mechanism 56 in the lower portion 46 of the rear door thus establishing the upper window portion 42 in a locked, yet opened position.

If an individual wishes to create cross ventilation within the vehicle, the individual would engage lower door portion 46 in its closed position and open upper window portion 42. Body member 16 of window latch extender 10 and facing plate 26 would then be positioned about window hasp 54 such that wing bolt 28 would pass through aperture 27 in facing plate 26 and threadedly engage aperture 24 in body member 16. Window hasp 54 is thus positioned in channel 30 between recessed surface 22 and facing plate 26, in locking engagement with window latch extender 10 such that lock engaging hasp member 12 of window latch extender 10 is positioned to engage locking mechanism 56 in door 46 when window 42 is pivoted towards a closed, locked position.

Window 42 therefore becomes locked in engagement with door 46, however, a gap exists between window 42 and door 46, such gap approximately equal to the length of lock engaging hasp member 12 of window latch extender 10 as illustrated in FIG. 6. This gap provides for the cross ventilation of the vehicle while in operation by allowing vented air entering the front of the vehicle either by means of a slight opening of the window or the opening of the internal vents of the vehicle to flow rearwardly and exit the vehicle through the gap between the window and the door. The gap is not sufficient to allow personal belongings or other items to exit the vehicle, yet does permit the cross ventilation and does secure the window in a locked position.

U.S. Pat. No. 5,551,738 discloses a different system configured to hold a pivotable hatch of a vehicle in a partially open position and to close a switch indicating that the pivotable hatch is open. The system includes a one piece latch extender including a base configured to engage a locking mechanism of the vehicle and coupling member formed on the latch extender. The coupling member is configured to apply a spring force to a hasp on the hatch of the vehicle to couple the latch extender to the hasp and to position the base a predetermined distance from the hasp so that the pivotable hatch remains in a partially open position upon engagement of the base with the locking mechanism. The system also includes an auxiliary post configured to be attached to a post coupled to the hatch of the vehicle to engage and close the switch when the pivotable hatch is in the partially open position.

U.S. Pat. No. 6,048,045 also teaches an extender for the U-shaped striker found on the pivotally opening rear window of a motor vehicle to engage the rear door locking mechanism of the vehicle and maintain the rear window in a partially opened yet securely locked position for ventilation of the interior of the vehicle. The striker extender being U-shaped and pivotally affixed to the striker so that it can easily be moved into a first or parallel position for use and a second or perpendicular position for storage. The striker extender does not have to be removed and is always ready for use and easily placed in the desired position without the need for any tools or special skills. Once the window is locked in the partially opened position, the striker extender cannot be removed from outside the vehicle and therefore unauthorized access to the vehicle's interior is not possible.

SUMMARY OF THE INVENTION

This invention improves upon the prior art by providing a latch extender with a quick-release mechanism. In a vehicle of the type with a window having a U-shaped hasp that engages with a hasp-locking mechanism on the vehicle when the window is closed, the device is configured to mount between the hasp and the locking mechanism to keep the window in a partially opened condition for ventilation purposes.

The device preferably includes a body having first and second ends, the first end of the body including a substitute hasp for engaging with the hasp-locking mechanism on the vehicle, and the second end of the body including an opening for receiving the U-shaped hasp of the window. In contrast to existing devices, the body further includes a quick-release mechanism for engaging the U-shaped hasp of the window, the quick-release mechanism including a manually operated control on the body for releasing the U-shaped hasp of the window.

In the preferred embodiment the manually operated control is a spring-biased pushbutton. The substitute hasp is also preferably generally U-shaped, and may be curved or bent to accommodate particular vehicle configurations.

DETAILED DESCRIPTION OF THE INVENTION

Figure 1:
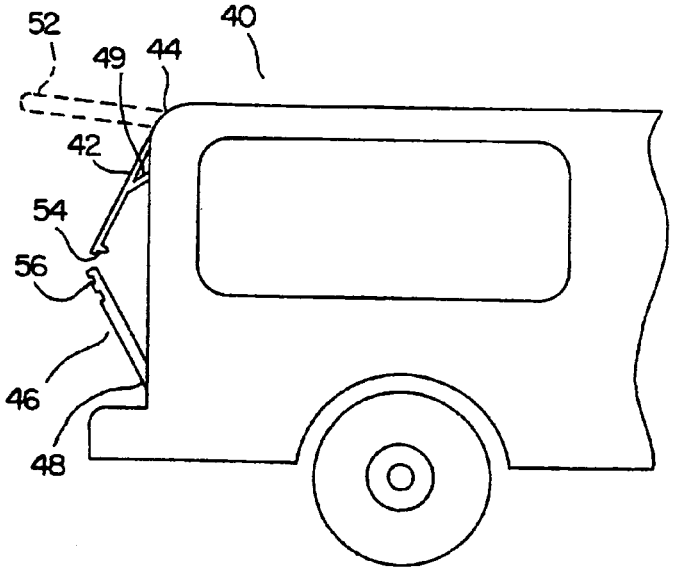
Fig - 1 (PRIOR ART)
FIG. 1 is a drawing of a rear window assembly applicable to the present invention, taken from U.S. Pat. No. 5,165,742.
Figure 2:
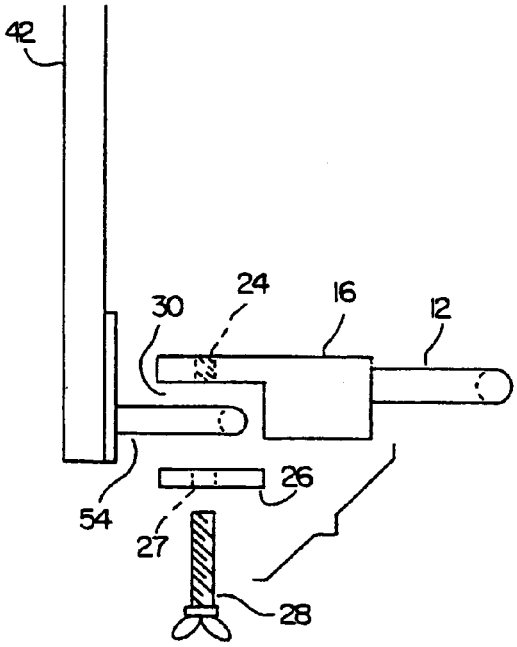
Fig - 2 (PRIOR ART)
FIG. 2 is a drawing of prior-art latch extender taken from U.S. Pat. No. 5,165,742.
Figure 3:
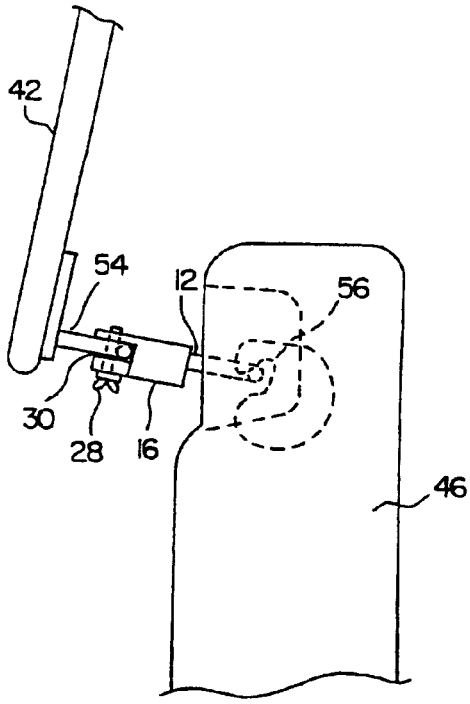
Fig - 3 (PRIOR ART)
FIG. 3 is a drawing of the prior-art latch extender of FIG. 2 installed on a vehicle.
Figure 5:
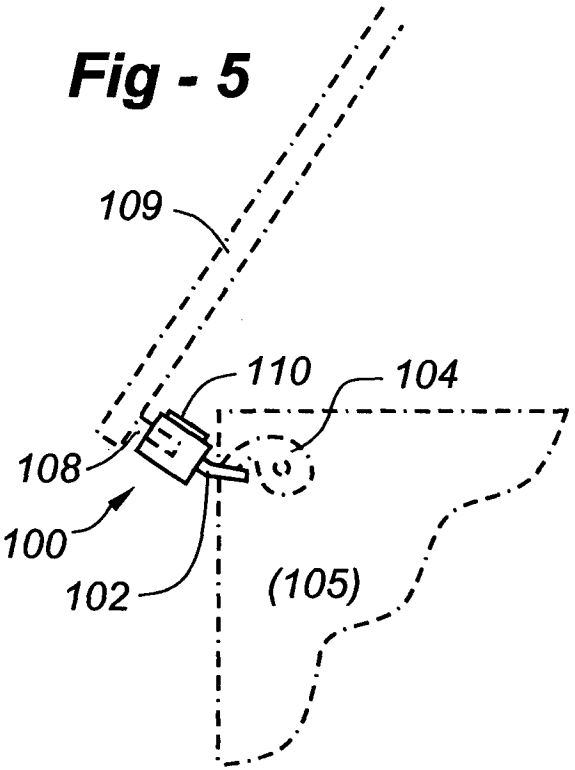
FIG. 5 is a drawing of the device of FIG. 4 installed on a vehicle.
Figure 4:
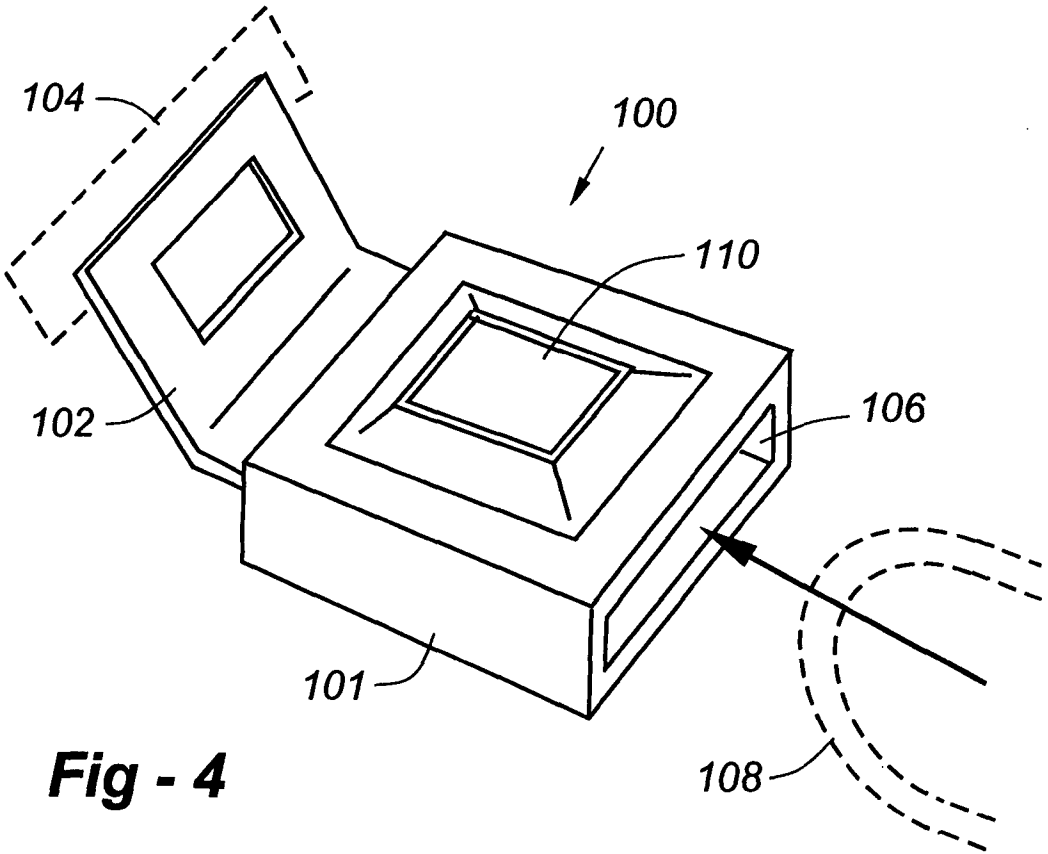
FIG. 4 is a drawing of a preferred embodiment of the invention.

Now turning to the drawings, FIG. 4 depicts an embodiment of the present invention, and FIG. 5 shows the device installed on a vehicle. The preferred embodiment, shown generally at 100, a body 101, having a first end with a substitute hasp 102 adapted to engage with an existing locking mechanism on a vehicle, shown schematically as 104. The body 101 further includes an opposing end including an opening 106 to receive a U-shaped hasp on a vehicle window, shown schematically at 108.

In contrast to existing devices, the unit 100 includes a quick-release mechanism such that, with hasp portion 108 inserted opening 106, activation of the quick-release mechanism disengages the hasp 108 from within the body 101, enabling the device to be removed. This is an improvement over existing configurations that utilize more permanent coupling mechanisms such as threaded fasteners. With these existing, prior-art devices, a user must have a screwdriver available, causing considerable inconvenience when the window must be temporarily closed for weather conditions, security purposes, and so forth.

Figure 6:
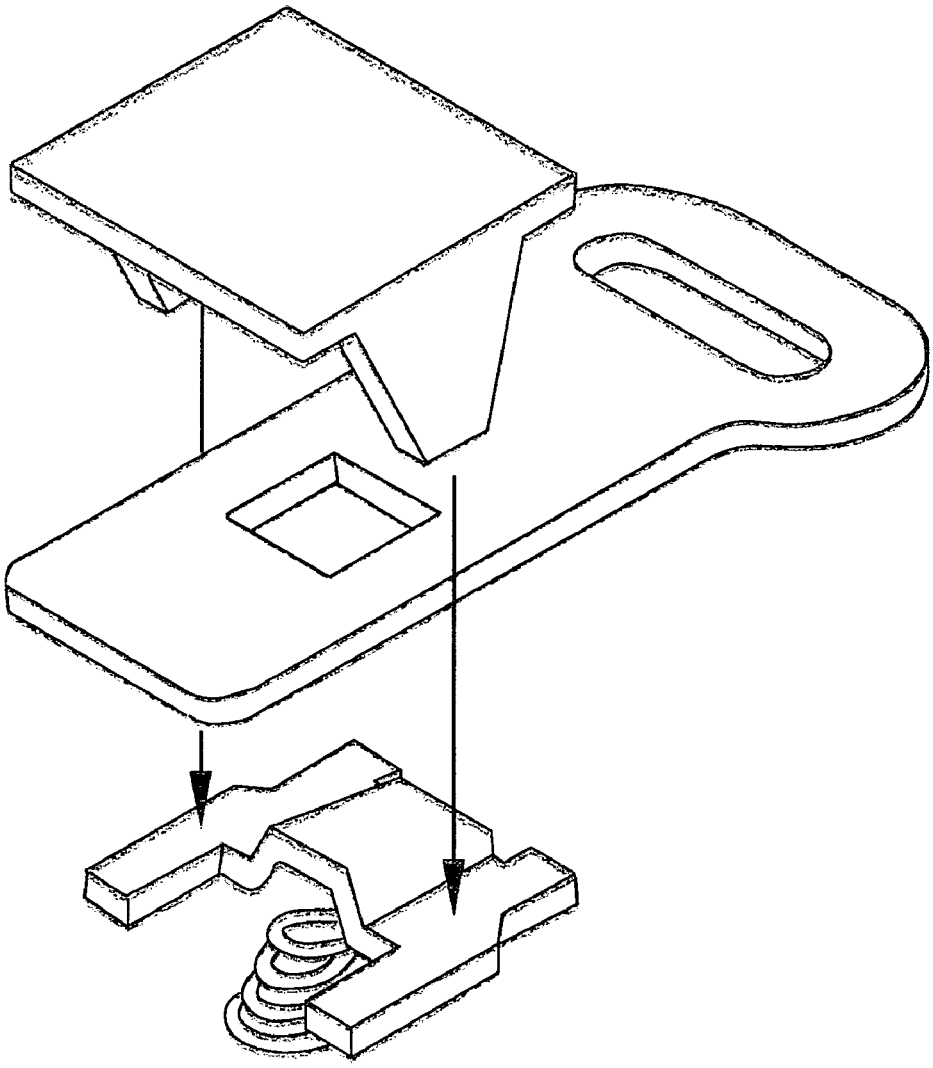
FIG. 6 shows a typical mechanism, taken from U.S. Pat. No. 3,795,030.

In the preferred embodiment, a quick-release mechanism is similar to that used on existing seat belts, in that it includes a manually operated button 110 coupled with a spring-biased capture mechanism within the 101 of the device 100. FIG. 6 shows a typical mechanism, taken from U.S. Pat. No. 3,795,030. Slipping the hasp 108 into the opening 106 causes the capture hasp 108, whereas pressing down on the button 110 releases it, again, much like that used for existing seatbelts. However, those of the skill in the mechanism art will appreciate that other types of release mechanisms may be used, including multiple opposing buttons on each side or on the top and button of the release mechanisms that rotate instead of being pushed, and so forth.

Hasp 102 is preferably in the form of a plate welded or otherwise connected to the body 101. In the preferred configuration, the plate 102 is bent to better align with certain vehicles, as perhaps better seen in the installed diagram of FIG. 5. As with the quick-release mechanism, although a bent plate 102 is used as the substitute hasp, other configurations may be used, including a bent U-shaped hasp 108 found on the window.

FIG. 5 is a side-view drawing showing the way in which the device 100 is connected between a pivoting window 109 and locking mechanism 104. The overall length of the device 100 is such that with the device installed as shown in FIG. 4, it would be difficult if not impossible for somebody to reach between the spacer created between window 109 and the vehicle 105 and press the button 110 to release the device. Thus, a length of the device on the order of just a few inches is preferred.

I claim:

1. For use in conjunction with a vehicle of the type with a window having a U-shaped hasp that engages with a hasp-locking mechanism on the vehicle when the window is closed, a device configured to mount between the hasp and the locking mechanism to keep the window in a partially opened condition, comprising:

a body having first and second ends;

the first end of the body including a substitute hasp for engaging with the hasp-locking mechanism on the vehicle;

the second end of the body including an opening for receiving the U-shaped hasp of the window; and the body including a quick-release mechanism for engaging the U-shaped hasp of the window, the quick-release mechanism including a spring-biased pushbutton on the body for releasing the U-shaped hasp of the window.

2. The device of claim 1, wherein the substitute hasp is also generally U-shaped.

3. The device of claim 1, wherein the substitute hasp is curved or bent to accommodate particular vehicle configurations.

* * * * *